US005826127A

United States Patent [19]

Evans et al.

[11] Patent Number: 5,826,127

[45] Date of Patent: Oct. 20, 1998

[54] RELATING TO PHOTOGRAPHIC PROCESSING APPARATUS

[75] Inventors: Gareth B. Evans, Potten End; Anthony Earle, Harrow Weald, both of England

[73] Assignee: Eastman Kodak Company, Rochester, N.Y.

[21] Appl. No.: 762,224

[22] Filed: Dec. 9, 1996

[30] Foreign Application Priority Data

Jan. 4, 1996 [GB] United Kingdom ..... 9600112

[51] Int. Cl.[6] ..... G03D 3/10

[52] U.S. Cl. ..... 396/571; 396/616; 396/620; 355/27

[58] Field of Search ..... 396/571, 573, 396/576, 577, 578, 612, 616, 617, 620, 622, 575, 44, 46, 47; 355/27, 28, 100, 106

[56] References Cited

U.S. PATENT DOCUMENTS

| | | | |
|---|---|---|---|
| 4,240,737 | 12/1980 | Lawson | 396/575 |
| 4,304,484 | 12/1981 | Mizuta et al. | 396/616 |
| 4,505,565 | 3/1985 | Tanaka | 396/571 |
| 4,600,287 | 7/1986 | Hotta et al. | 396/571 |
| 4,881,095 | 11/1989 | Shidara . | |
| 5,179,404 | 1/1993 | Bartell et al. . | |
| 5,223,882 | 6/1993 | Baekmann . | |
| 5,270,762 | 12/1993 | Rosenburg et al. | 396/636 |
| 5,294,956 | 3/1994 | Earle . | |
| 5,309,191 | 5/1994 | Bartell et al. | 396/636 |
| 5,313,241 | 5/1994 | Seim | 396/636 |

FOREIGN PATENT DOCUMENTS

| | | |
|---|---|---|
| 0 559 025 | 9/1993 | European Pat. Off. . |
| 0 559 026 | 9/1993 | European Pat. Off. . |
| 0 559 027 | 9/1993 | European Pat. Off. . |
| 2 059 813 | 4/1981 | United Kingdom . |
| 2 124 409 | 2/1984 | United Kingdom . |
| 91/12567 | 8/1991 | WIPO . |
| 91/19226 | 12/1991 | WIPO . |
| 92/07301 | 4/1992 | WIPO . |
| 92/07302 | 4/1992 | WIPO . |
| 92/09932 | 6/1992 | WIPO . |
| 92/10790 | 6/1992 | WIPO . |
| 92/17370 | 10/1992 | WIPO . |
| 92/17819 | 10/1992 | WIPO . |
| 93/000612 | 1/1993 | WIPO . |
| 93/04404 | 3/1993 | WIPO . |

*Primary Examiner*—A. A. Mathews
*Attorney, Agent, or Firm*—Frank Pincelli

[57] ABSTRACT

Photographic processing apparatus in which both exposing and processing stages of a photographic process are combined to form a single unit or linked so that a continuous web of photographic film or paper is used in both units at the same time is known. However, due to differences in speed of the exposing and processing stages, there is a need to store a "buffer" length of the material being processed between the two stages. Described herein is a method of varying the speed of the processing stage of photographic processing apparatus to compensate for changes in the capacity of a processor while maintaining a constant path length. This achieved by changing its activity of one of the steps in the processing stage, for instance, by changing the temperature of the development step. This is feasible without unacceptable time delays or energy or chemical consumption associated with changing the solution activity by the use of low volume tanks with low capacity. The system can be controlled by providing a means of maintaining the transport speed of the paper using the measured temperature of the solution.

7 Claims, 3 Drawing Sheets

RELATING TO PHOTOGRAPHIC PROCESSING APPARATUS

FIELD OF THE INVENTION

The present invention relates to improvements in or relating to photographic processing apparatus, and is more particularly, although not exclusively, concerned with photographic processing apparatus whose capacity or the output rate is varied in accordance with need.

BACKGROUND OF THE INVENTION

Photographic processing apparatus in which both exposing and processing stages of a photographic process are combined to form a single unit or linked so that a continuous web of photographic film or paper is used in both units at the same time is known. In the particular case of photographic processing apparatus in which photographic paper is exposed (or printed) and processed in a single unit comprising two processing stages or two linked processing stages, the processing apparatus is not normally self-threading and a "leader" is attached to the leading end of the photographic paper in web form to pull it through the initial part of the apparatus. The "leader" normally comprises a material which is different from the material being processed.

When processing of the photographic paper stops, a further "leader" may be attached to the end of the paper web and remains in the apparatus until it is next required for processing. At this point, more photographic paper for processing can be attached to the free end of the "leader".

In order to allow for situations when printing stops temporarily, it is usual to provide a means of storing an accumulated length of the photographic paper in web form in the path between the printing stage and the processing stage. This accumulated length of paper takes some time to be passed to the processing stage thus allowing printing to be resumed before the need to either process unexposed and wasted paper or attach a length of leader material.

Also, this "buffer" length of paper allows the rate of production of exposed paper produced in the printing stage to be temporarily different from the rate at which paper is transported through the processing stage. Variations in output from the printing stage can occur in situations where routine printing is not being carried out, for example, in the case of reprints. Here, the printing stage is printing reprints which occur infrequently at a slower rate than routine printing.

Usually the "buffer" length is produced by a magazine of rollers (sometimes called an "elevator") whose spacing can be varied to vary the total path length. Such magazines are complex and expensive to manufacture and require maintenance.

Ideally, the processing stage should run at a variable rate in concert with the printing stage thus eliminating the need for a large buffer.

One solution to this problem is to vary the path length in the developer step of the processing stage and adjust the linear speed of the web to maintain the time in the developer. This has been done by using similar means to the buffer magazine arrangements in the transport systems in the developer step of the processing stage.

Another method of providing a variable speed is to vary the time of the process. This is normally done to provide the ability to carry out processing in different processing apparatus using the same paper and process solutions. In this case, the temperature of the developer solution is chosen in accordance with the required development time.

US-A-4 600 287 discloses a method and device for automatically controlling the time period of photographic development for specific combinations of photographic developers and photographic materials so that substantially the same or optimum photographic development result at various temperatures. As there is a relationship between development time and temperature of the developer solution, the development time is adjusted by varying the transport speed of the photographic material through the developer solution.

PROBLEM TO BE SOLVED BY THE INVENTION

In conventional photographic processing apparatus, however, such as in US-A-4 600 287 described above, the volumes of the processing tanks are large and the thermal capacity of the solutions contained therein slows down the rate of temperature change. Another consequence of the large volumes is that the energy required to heat and cool the solutions is large.

SUMMARY OF THE INVENTION

It is therefore an object of the present invention to provide a means of varying the processing capacity of photographic processing apparatus, particularly in a unit which comprises both a printing stage and a processing stage so that printing and processing speeds can be changed together thus reducing the need for a buffer magazine. This also overcomes the problems associated with large solution volumes which waste time and energy if a temperature change is used to allow a process time change.

In accordance with one aspect of the present invention, there is provided a method of processing photographic material in a photographic processing apparatus comprising a printing stage and a processing stage, the processing stage having at least one processing tank in which the processing solution volume divided by the maximum area of the material immersed in the processing solution is less than 25 mm, characterized in that the transport speed of the photographic material through the processing tank is varied in accordance with development time and a change of processing solution activity to maintain a predetermined photographic performance.

In accordance with another aspect of the present invention, there is provided photographic processing apparatus for processing photographic material, the apparatus comprising a printing stage and a processing stage, the processing stage having at least one processing tank in which the transport speed of the photographic material therethrough is varied in accordance with development time and a change of processing solution activity to maintain a predetermined photographic performance, characterized in that at least one of the processing tank is such that its processing solution volume divided by the maximum area of the material immersed in the processing solution is less than 25 mm.

ADVANTAGEOUS EFFECT OF THE INVENTION

The present invention combines processing tanks of low volume which use thin tank cross sections, together with the use of changes in temperature to allow variable development times and therefore, transport speeds, in printer/processors using non-self-threading paper web transport systems.

BRIEF DESCRIPTION OF THE DRAWINGS

For a better understanding of the present invention, reference will now be made, by way of example only, to the accompanying drawings in which.

DETAILED DESCRIPTION OF THE INVENTION

Figure 1:
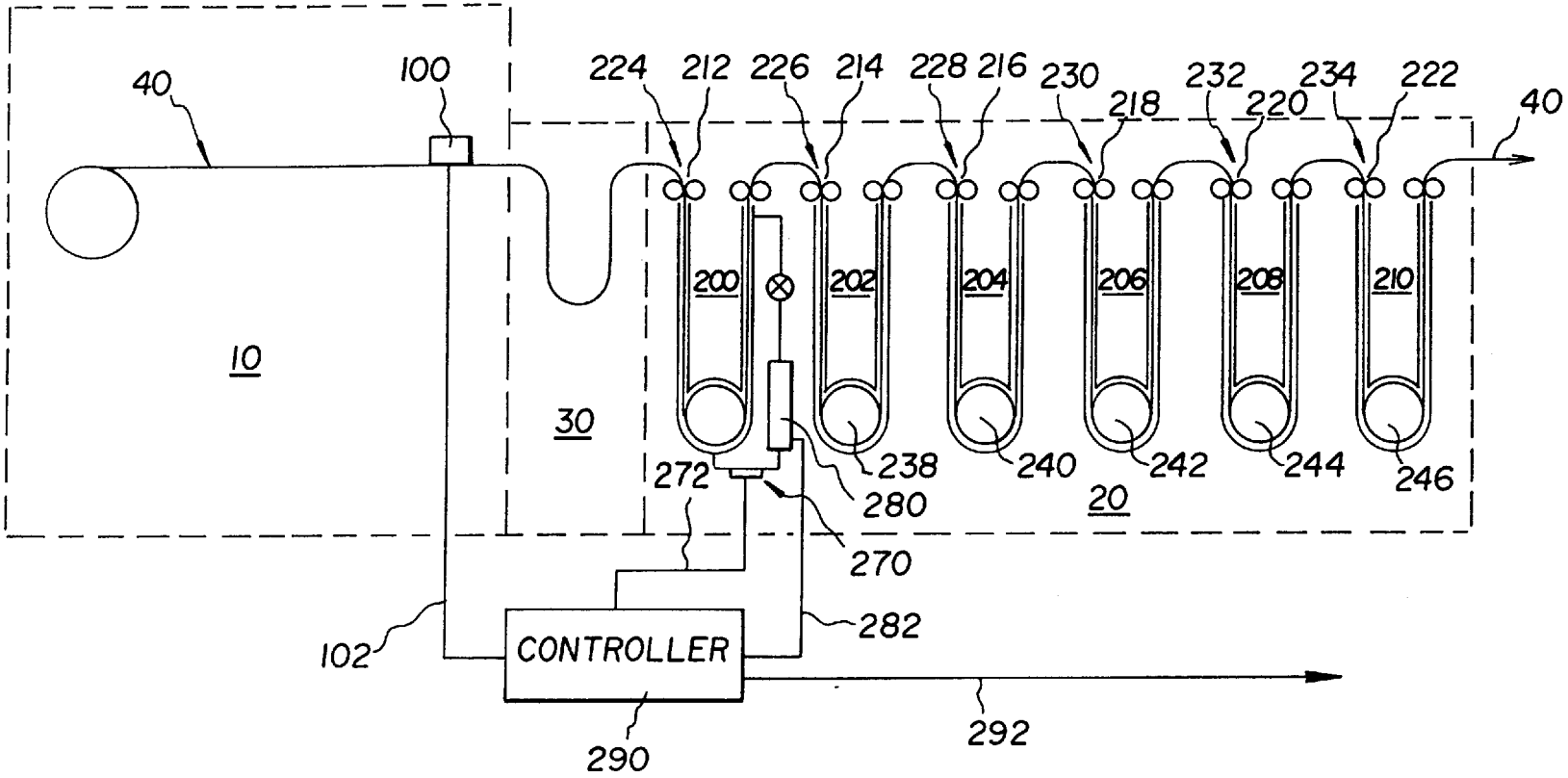
FIG. 1 illustrates a schematic block diagram of a combined printer/processor in accordance with the present invention.

The present invention preferably relates to photographic processing apparatus in which processing of a photographic material is carried out by passing the material through at least a developing tank containing developer solution which is recirculated through the tank at a rate of from 0.1 to 10 tank volumes per minute. Such a tank is often called a low volume thin tank (LVTT). The preferred recirculation rate is from 0.5 to 8, especially from 1 to 5, and in particular, from 2 to 4 tank volumes per minute.

The recirculation, with or without replenishment, is carried out continuously or intermittently. In one method of working, recirculation and replenishment can be carried out continuously while processing is in progress. In addition, the recirculation and replenishment may not be carried out at all or only intermittently when the apparatus is idle. Replenishment may be carried out by introducing the required amount of replenisher into the recirculation stream either inside or outside the processing tank.

It is advantageous to use a tank of relatively small volume in the implementation of the present invention. Hence, the ratio of tank volume to maximum area of material which can be accommodated in the tank (that is, the product of the maximum path length and the width of material) is less than $11dm^3/m^2$, preferably less than $3dm^3/m^2$.

The shape and dimensions of the processing tank are such that it holds the minimum amount of processing solution while still obtaining the required results. The tank is preferably one with fixed sides, the material being advanced therethrough by drive rollers. Preferably the photographic material passes through a thickness of solution less than 25 mm, preferably less than 11 mm. It is preferred that the solution thickness is less than 5 mm and especially about 2 mm. The shape of the tank is not critical but it could be in the shape of a shallow tray or, preferably U-shaped to provide a processing channel through which the material to be processed passes. It is preferred that the dimensions of the tank be chosen so that the width of the tank is the same or only just wider than the maximum width of the material to be processed, for example, the width if a single strand of material or the combined width of several strands of material being processed at the same time. Each processing stage, for example the development stage, can be arranged to occupy several tanks.

The total volume of the processing solution within the processing channel of a processing tank and its recirculation system is relatively smaller as compared to prior art processors. In particular, the total amount of processing solution in the entire processing system for a particular module (that is, the processing channel and the recirculation system) is such that the total volume in the processing channel is at least 40% of the total volume of processing solution in the processing system. Preferably, the volume of the processing channel is at least about 50% of the total volume of the processing solution in the processing system.

In order to provide efficient flow of the processing solution through the openings or nozzles into the processing channel, it is desirable that the nozzles/openings which deliver the processing solution to the processing channel have a configuration in accordance with the following relationship:

$$0.6 \leq F/A \leq 23$$

wherein:

F is the flow rate of the solution through the nozzle in liters/minute; and

A is the cross-sectional area of the nozzle or opening provided in $cm^2$.

Providing a nozzle in accordance with the foregoing relationship assures appropriate discharge of the processing solution against the photosensitive material. Such low volume thin tank systems are described in more detail in US-A-5 294 956, US-A-5 179 404, US-A-5 270 762, EP-A-0 559 025, EP-A-0 559 026, EP-A-0 559 027, WO-A-92/10790, WO-A-92/17819, WO-A-93/04404, WO-A-92/17370, WO-A-91/19226, WO-A-91/12567, WO-A-92/07302, WO-A-93/00612, WO-A-92/07301, and WO-A-92/09932.

In accordance with the present invention, the processing tank in which adjustment of the activity is required is the tank in which the majority of the image on the material being processed is produced, that is, the developer tank of the processing stage. In particular, the temperature of the developer solution can be altered to provide changes in activity.

The present invention is particularly useful in systems which have a combined printer and processor for producing prints on photographic paper where variable printing rates require variable processor capacity (prints per hour).

FIG. 1 illustrates a combined printer/processor 1 which comprises a printer unit 10, a processor unit 20 and a buffer unit 30 connecting the printer unit 10 to the processor unit 20. A web of photographic paper 40 is shown passing through the printer/processor 1.

It will be appreciated that specific features of the printer unit 10 and the buffer unit 30 are well known and are outside the scope of the present invention. As a consequence, no further description of the printer unit 10 or buffer unit 30 will be given here.

The processor unit 20 comprises a plurality of processing tanks 200, 202, 204, 206, 208, 210 arranged therein. Each processing tank 200, 202, 204, 206, 208, 210 carries out a given step during processing of the web 40, for example, tank 200 comprises a developer tank, tank 202 comprises a bleach tank, tank 204 comprises a fixer tank, and tanks 206, 208, 210 are wash tanks.

As shown, each tank 200, 202, 204, 206, 208, 210 comprises a low volume thin tank (LVTT) as discussed above, each having a generally U-shaped processing channel. Web 40 is driven through each tank 200, 202, 204, 206, 208, 210 by respective drive roller pair 212, 214, 216, 218, 220, 222 located adjacent its associated inlet 224, 226, 228, 230, 232, 234, and around lower rollers 236, 238, 240, 242, 244, 246 as shown.

Although six tanks are shown in FIG. 1, it will be appreciated that more or fewer tanks may be present depending on the type of photographic paper being processed and also the type of chemistry used for the processing.

As mentioned above, the processing tank in which the adjustment of activity is required is the tank in which the majority of the image on the web 40 is produced, that is, in the developer tank 200. The operation of the present invention will therefore be described in more detail with reference to the developer tank 200.

Figure 2:
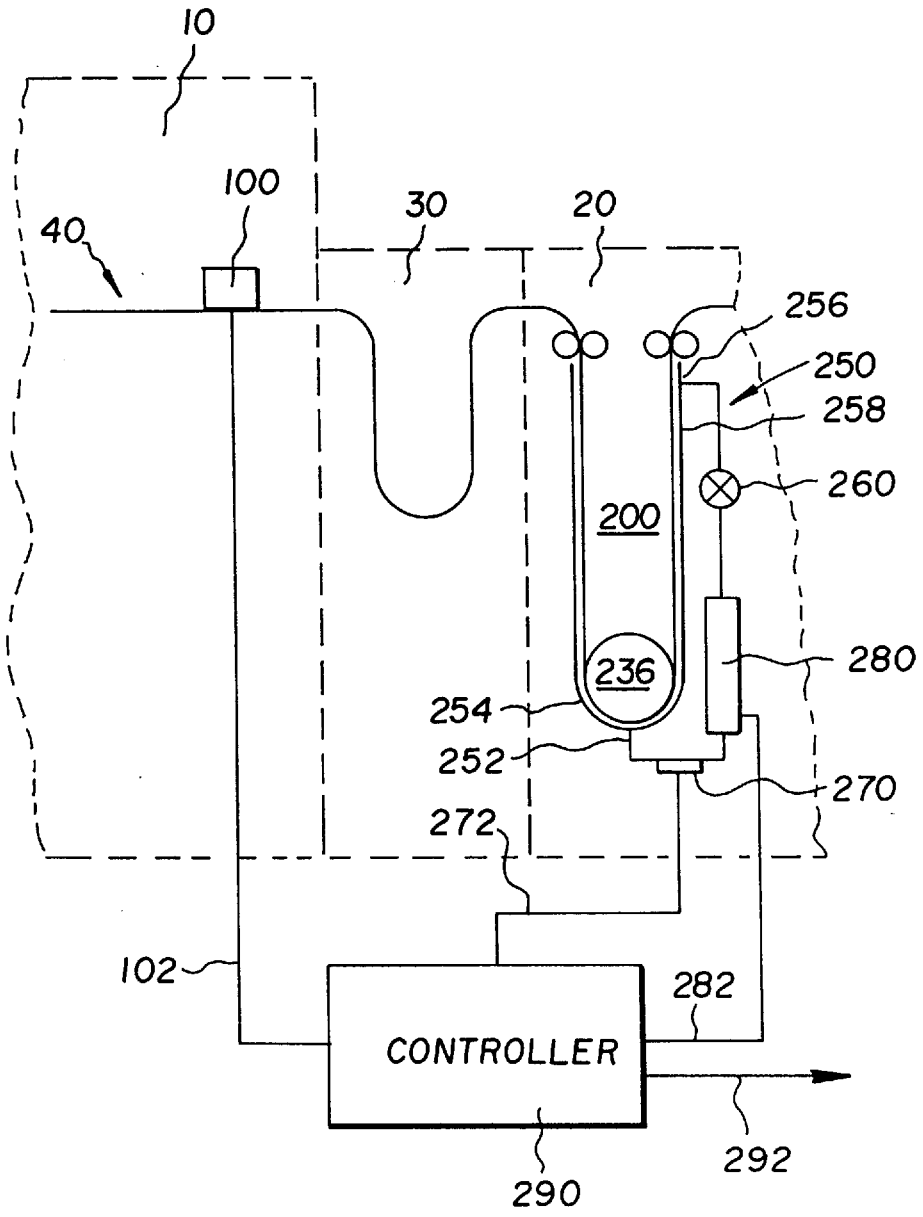
FIG. 2 is an enlarged view of the developer tank of the FIG. 1 printer/processor.

Developer tank 200, as shown more clearly in FIG. 2, has a recirculation system 250 connected to it which comprises an outlet 252 formed in bottom 254 of tank 200 through which developer solution is removed therefrom, an inlet 256 located in side wall 258 of tank 200 through which developer solution is re-introduced therein, and a pump 260 for cycling the developer solution between the outlet 252 and inlet 256. A temperature sensor 270 and a heater 280 are also provided in the recirculation system 250.

In accordance with the present invention, the temperature of the developer solution is controlled in relation to the transport speed of the web 40 from the printing unit 10. A controller 290 is connected to the recirculation system 250 by means of temperature sensor 270 via line 272 and heater 280 via line 282. The controller 290 takes output signals from sensor 270 and controls heater 280 in accordance with output signals received from a speed sensor 100 located at the output of printing unit 10 via line 102. The controller 290 also sends control signals to a web drive mechanism (not shown) along line 292.

It is known that the temperature of the developer solution is related to the processing time. For Kodak Ektacolor Prime and Kodak Ektacolor RA developer replenishers (Ektacolor and Prime are trade marks of Eastman Kodak Company), processing times for predetermined temperatures are given in Table 1 below.

TABLE 1

| Time | KODAK EKTACOLOR PRIME Developer Replenisher or KODAK EKTACOLOR RA 100 Developer Replenisher Temperature | | KODAK EKTACOLOR RA Developer Replenisher or EKTACOLOR RA Developer Replenisher RT Temperature | |
|---|---|---|---|---|
| min:sec | °C. | °F. | °C. | °F. |
| 0:45 | 37.8 ± 0.3 | 100.0 ± 0.5 | 35.0 ± 0.3 | 95.0 ± 0.5 |
| 1:00 | 35.6 ± 0.3 | 96.0 ± 0.5 | 32.8 ± 0.3 | 91.0 ± 0.5 |
| 1:15 | 34.2 ± 0.3 | 93.5 ± 0.5 | 31.4 ± 0.3 | 88.5 ± 0.5 |
| 1:30 | 32.8 ± 0.3 | 91.0 ± 0.5 | 30.0 ± 0.3 | 86.0 ± 0.5 |
| 1:40 | 32.2 ± 0.3 | 90.0 ± 0.5 | 29.4 ± 0.3 | 85.0 ± 0.5 |

Figure 3:
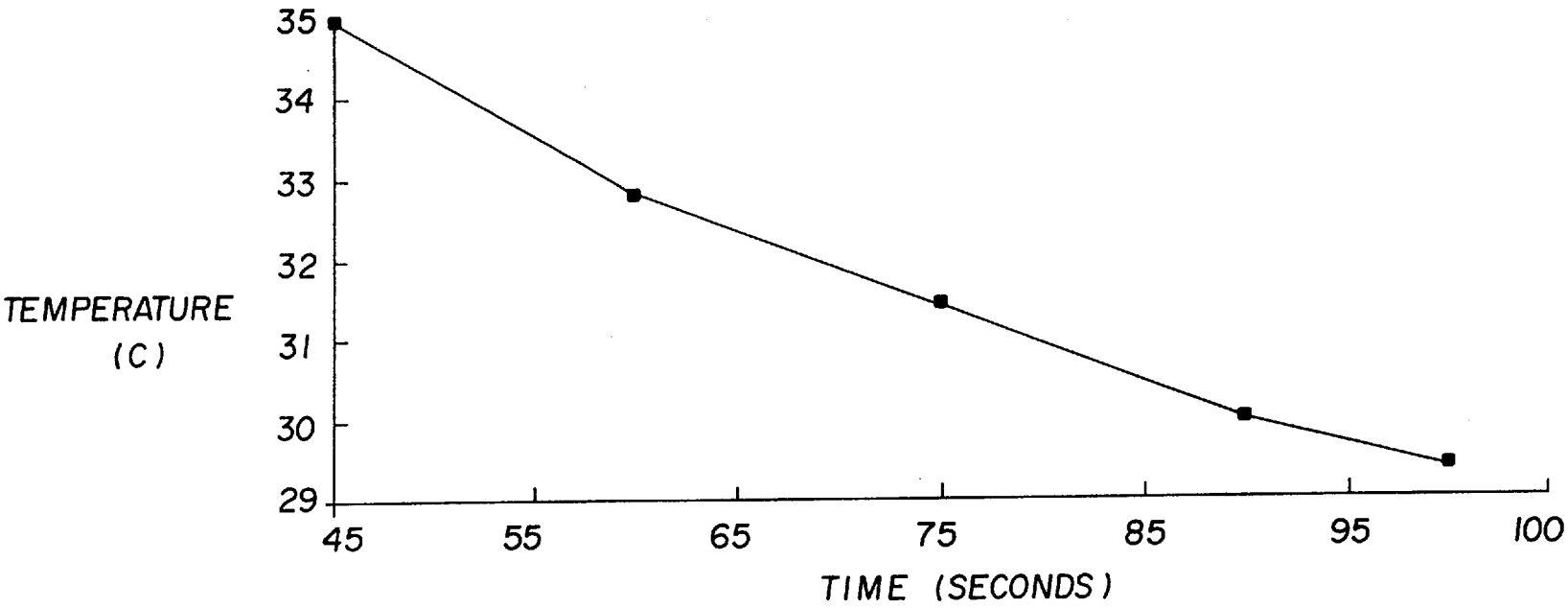
FIG. 3 is a graph illustrating the relationship between developing time and temperature for EKTACOLOR RA4 processing chemistry.

FIG. 3 shows a graph of temperature (in degrees Celsius) against developer time (in seconds) for EKTACOLOR RA4 developer without regeneration. It can readily be seen that the shorter the development time, the higher the temperature of the developer solution to produce the correct photographic performance.

Although the present invention has been described with reference to standard materials which are conventionally processed using RA4 chemistry, it is also equally applicable to redox amplification (RX) materials and processes for which LVTT designs are particularly valuable.

Redox amplification processes have been described, for example, in GB-A-1 268 126, GB-A-1 399 481, GB-A-1 403 418 and GB-A-1 560 572. In such processes, color materials are developed to produce a silver image (which may contain only small amounts of silver) and then treated with a redox amplifying solution (or a combined developer-amplifier) to form a dye image.

The developer-amplifier solution contains a color developing agent and an oxidizing agent which will oxidize the color developing agent in the presence of the silver image which acts as a catalyst.

Oxidized color developer reacts with a color coupler to form the image dye. The amount of dye formed depends on the time of treatment or the availability of color coupler and is less dependent on the amount of silver in the image as is the case in conventional color development processes.

Examples of suitable oxidizing agents include peroxy compounds including hydrogen peroxide and compounds which provide hydrogen peroxide, for example, addition compounds of hydrogen peroxide or persulphates; cobalt (III) complexes including cobalt hexammine complexes; and periodates. Mixtures of such compounds can also be used.

A particular application of RX processes is in the processing of silver chloride color paper, for example, paper comprising at least 85 mole percent silver chloride, especially such paper with low silver levels, for example, total silver levels below 130mg/m$^2$, for example, from 25 to 120mg/m$^2$, preferably below 60 mg/m$^2$, and particularly in the range 20 to 60mg/m$^2$. Within these total ranges the blue sensitive emulsion layer unit may comprise 20 to 60mg/m$^2$, preferably 25 to 50mg/m$^2$ with the remaining silver divided between the red and green-sensitive layer units, preferably more or less equally between the red and green-sensitive layer units.

In the case of RX materials, the stage controlled would be a single developer/amplifier stage, or at least one of a combination of separate development stages as for instance, in the case when a non-amplifying developer stage followed by an amplifying stage, including the case where the amplifying stage also involves bleaching the silver image.

When processing RX materials, the LVTT tank thickness is preferably less than 11 mm.

The present invention has the advantage that variable processing speeds can be provided without the complexity of varying the path length of the processing channel. Moreover, large buffer magazines are avoided. As low volumes of processing solutions are used in LVTT arrangements, time delays and excess energy losses are also avoided.

The transport speed could be controlled by the measured temperature of the developer solution. This would allow automatic changes in transport speed and capacity in accordance with temperature changes which occurred either as a result of deliberate choice of temperature to produce the required capacity or by variations in temperature so that such variations produce system capacity changes but, importantly, do not result in variable photographic quality. Provided such temperature changes are slow relative to process times, the capacity can be continuously altered as temperatures change. This would be useful as systems are warmed up and cooled down between periods of high capacity activity.

As an alternative to varying the temperature, it is envisaged that the chemical content of the developer solution could be altered in accordance with the processing time. The low volumes of the processing tanks described above allow this type of adjustment without excessive use of chemistry or energy.

The present invention is particularly relevant to printing and processing photographic paper in a combined printer/processor. However, it will be readily appreciated that the present invention is not so limited.

It is to be understood that various other changes and modifications may be made without departing from the scope of the present invention. The present invention being defined by the following claims:

Parts List:

10 printer unit
20 processor unit
30 buffer unit
40 photographic paper

100 speed sensor
102 line
200,202,204,206,208, 210 processing tanks
212,214,216,218,220,222 drive roller pair
224,226,228,230,232,234 inlet
236,238,240,242,244,246 lower rollers
250 recirculation system
252 outlet
254 bottom
256 inlet
258 side wall
260 pump
270 temperature sensor
272,282 line
280 heater
290 controller
292 line

We claim:

1. A method of processing a continuous web of photographic material in a combined photographic processing apparatus comprising a printing stage and a processing stage, the processing stage having at least one processing tank in which the processing solution volume divided by the maximum area of the material immersed in the processing solution is less than 25 mm, the method comprising the steps of:

sensing a transport speed of the photographic material through the printing stage;

varying the transport speed of the photographic material through the processing tank in response to a sensed change of the transport speed of the photographic material through the printing stage; and changing an activity of the processing solution in accordance with the sensed transport speed thereby to maintain a predetermined photographic performance.

2. A method according to claim 1, wherein the activity of the processing solution is varied by controlling a temperature of the processing solution.

3. A combined photographic processing apparatus for processing a continuous web of photographic material, the apparatus comprising a printing stage and a processing stage, wherein a transport speed of the web through the printing stage is arranged to be varied, the apparatus comprising means arranged to sense the transport speed of the web through the printing stage, the processing stage having at least one processing tank in which the transport speed of the photographic material therethrough is varied in response to the sensed transport speed of the web through the printing stage, and an activity of the processing solution is varied in accordance with the transport speed of the web through the processing stage to maintain a predetermined photographic performance, wherein at least one of the processing tanks is such that its processing solution volume divided by the maximum area of the material immersed in the processing solution is less than 25 mm.

4. Apparatus according to claim 3, wherein the processing solution activity is controlled by a temperature of the processing solution.

5. Apparatus according to claim 3, wherein the solution volume divided by the maximum area of the material immersed in the processing solution is less than 11 mm.

6. Apparatus according to claim 5, wherein the solution volume divided by the maximum area of the material immersed in the processing solution is less than 5 mm.

7. Apparatus according to claim 6, wherein the solution volume divided by the maximum area of the material immersed in the processing solution is less than 3 mm.

* * * * *